United States Patent [19]

Chung

[11] Patent Number: 4,555,874

[45] Date of Patent: Dec. 3, 1985

[54] DUST COLLECTOR FOR GRINDER

[76] Inventor: Jen Y. Chung, 70, Alley 8 Ta Feng, Lane Fu Shang, Shui Nan Taichung, Taiwan

[21] Appl. No.: 552,770

[22] Filed: Nov. 17, 1983

[51] Int. Cl.[4] ..... B24B 55/06

[52] U.S. Cl. ..... 51/270; 51/273

[58] Field of Search ..... 51/270, 268, 273

[56] References Cited

U.S. PATENT DOCUMENTS 2,236,232 3/1941 Brescka et al. ..... 51/270

FOREIGN PATENT DOCUMENTS 221158 1/1959 Australia ..... 51/270

1024838 2/1958 Fed. Rep. of Germany ..... 51/270

19820 of 1902 United Kingdom ..... 51/270

*Primary Examiner*—Roscoe V. Parker

*Attorney, Agent, or Firm*—Lowe, King, Price & Becker

[57] ABSTRACT

A dust collector for grinder mainly comprising a dust bin, a filter box disposed in said dust bin, a dust chamber mounted at the lower part of said dust bin, two hoods mounted at the top of said dust bin, two blocking frames and two shields, characterized in that the dust collector may satisfactorily collect and filter the dust produced at the time of grinding out of the air.

2 Claims, 7 Drawing Figures

DUST COLLECTOR FOR GRINDER

BACKGROUND OF THE INVENTION

The present invention relates to a dust collector designed to collect dust produced by a grinder during grinding.

Referring to FIG. 5 and FIG. 6, there are shown a perspective view of a known grinder and a side view of the known grinder respectively. As shown, the grinder comprises two grinding wheels (a) each mounted within a hood (b). In operation, the grinding wheels (a) are driven by a motor (c).

When the motor (c) is turned on, the grinding wheels (a) will be driven to rotate so that the pressure within the hoods (b) will be less than that outside the hoods (b). Thus, the air accompanied with the dust produced by the grinding wheels (a) at the time of grinding will be sucked into the hood (b) from inlets (d); however, the air entrained with the dust will then exhaust out of outlets (e). Consequently, most of the dust produced during grinding will not be collected in hoods (b), contaiminating the air. Furthermore, the operator may inhale dust during grinding which is injurious to health.

In order to eliminate such a fatal drawback, a modified hood as shown in FIG. 7 has been proposed. The hood (f) is further provided with an outlet at its rear. Nevertheless, only one-third of the dust produced at the time of grinding will be exhausted out of the outlet (k). In short, there is hardly any use to keep the air fresh and the workshop clean.

Accordingly, it is the chief object of the present invention to obviate and mitigate such a drawback.

SUMMARY

It is the primary object of the present invention to provide a dust collector which is especially designed for use with grinder.

It is another object of the present invention to provide a dust collector which will collect dust produced at the time of grinding.

It is still another object of the present invention to provide a dust collector which is easy to produce.

It is a further object of the present invention to provide a dust collector which may obviate and mitigate the drawbacks which have long been suffered by the prior art dust collector for grinder.

Other objects and merits and a fuller understanding of the present invention will be obtained by those skilled in the art when the following detailed description of the best mode contemplated for practicing the invention has been read in conjunction with the accompanying drawings wherein like numerals refer to like or similar parts and in which:

DETAILED DESCRIPTION OF THE PREFERRED EMBODIMENT

Figure 1:
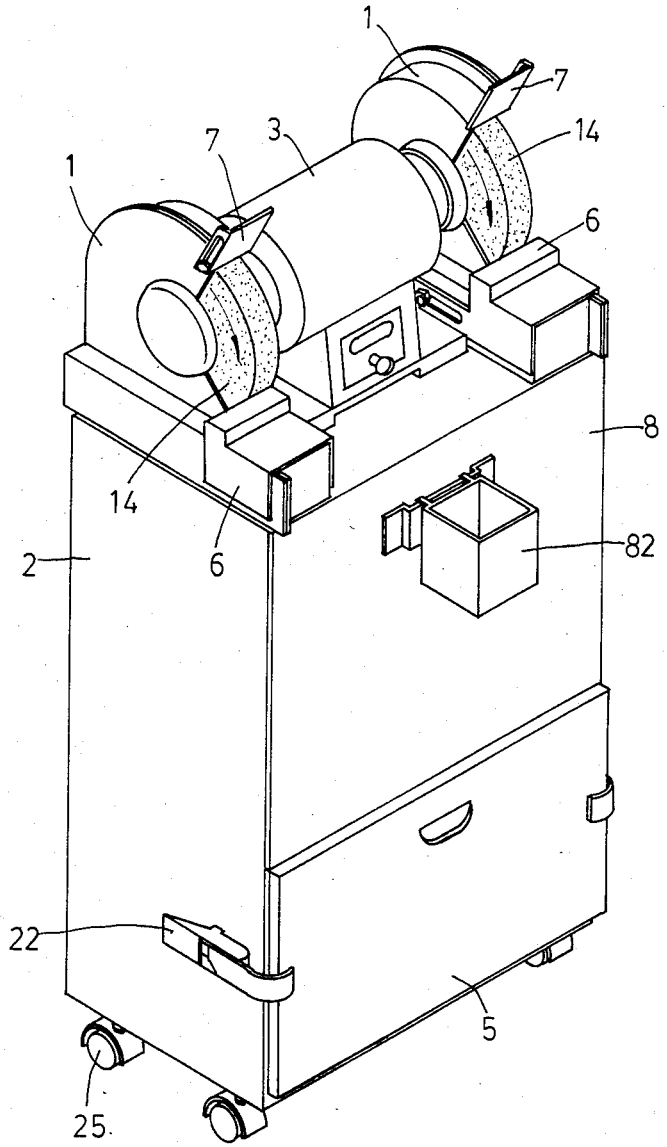
FIG. 1 is a perspective view of a dust collector for grinder according to a preferred embodiment of the present invention.

Referring now to FIG. 1, the dust collector according to the present invention comprises a dust bin (2) on which there are two hoods (1) and a motor (3). The motor (3) serves drive two grinding wheels (14) each mounted into one of the hoods (1). The dust produced at the time of grinding is collected in a dust chamber (5).

Figure 2:
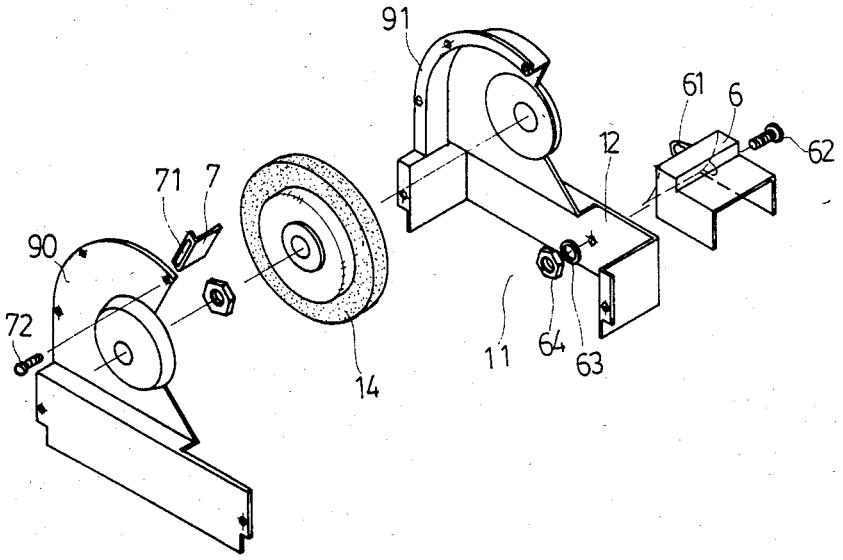
FIG. 2 is a fragmentary perspective view of a hood of the dust collector for grinder.

With reference to FIG. 1 and FIG. 2, each of the hoods (1) is composed of a left portion (90) and a right portion (91). A blocking frame (6) is mounted to an inlet (12) of the hood (1) by passing a screw (62) through a hole (61) of the blocking frame (6) and the hood (1) to engage with a washer (63) and a nut (64). Further, a shield (7) is mounted on the top of the hood (1) by passing a screw (72) through the left portion (90), a hole (71) of the shield (7), and the right portion (91). When the hood (91) is assembled, an opening (11) will be formed at the bottom of the hood (1).

Figure 3:
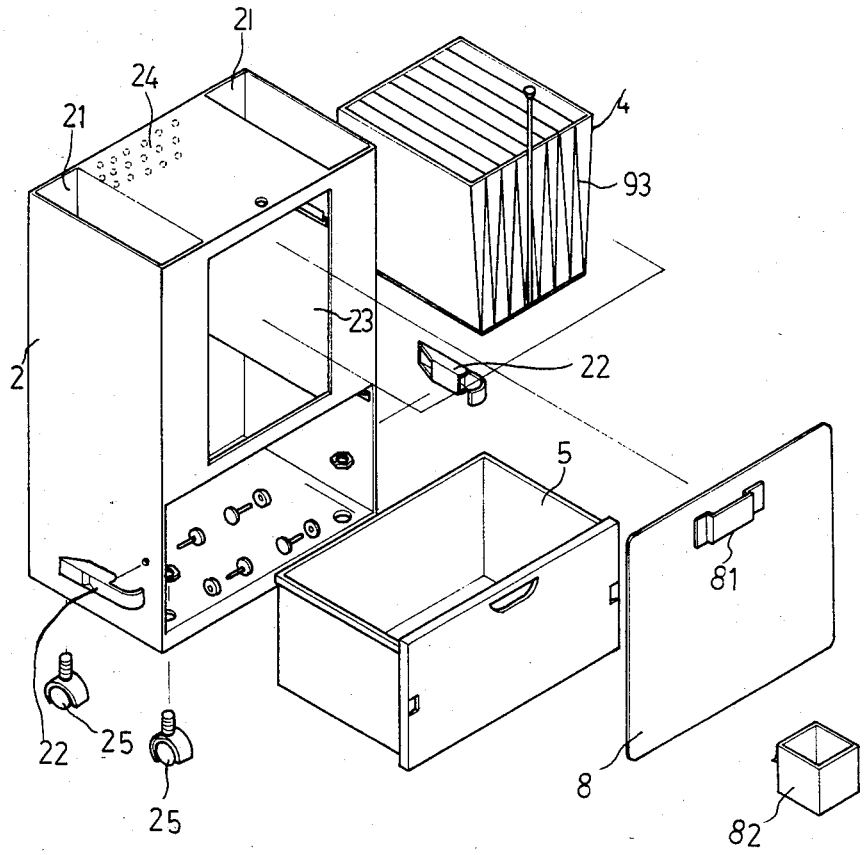
FIG. 3 is a fragmentary perspective view of a dust bin of the dust collector for grinder.

Referring to FIG. 1 and FIG. 3, the dust bin (2) is provided with a passage (21) and a fastener (22) at each side. The passage (21) is connected to the opening (11) of the hood (1) at its top and connected to dust chamber (5) at its bottom. The dust chamber (5) is in the shape of a drawer, which is normally closed by the fasteners (22). At the center of the dust bin (2) is a space (23) which communicates with the dust chamber (5). A filter box (4) is arranged into the space (23). The top of the dust bin (2) is provided with a plurality of holes (24) communicating with the space (23). The front of the space (23) is closed by a cover (8) which is equipped with a fixing frame (81) for holding a water tank (82). At the lowermost part of the dust bin (2) are four casters (25) (only three are shown), thereby facilitating the movement of the dust collector.

The filter box (4) is equipped a filter element (93) which is preferably made of filtering cloth. The filter element (93) is designed so that it can be possessed of large filtering area occupying a small space. According to numerous experiments, it has been found that the most economical area and filtering speed are as follows:

The optimum filtering area of the filtering element (93) is 2.4 $m^2$ when used with a $\frac{1}{2}$ HP grinder. As for a 1 HP grinder, the most economical filtering area of the filtering element (93) is 3.5 $m^2$. The best filtering speed (the speed of air passing through the filtering element) is 4–5 cm/sec. The filtering area and the filtering speed are calculated in accordance with the air flow rate and the cost of the filtering elements (93).

Figure 4:
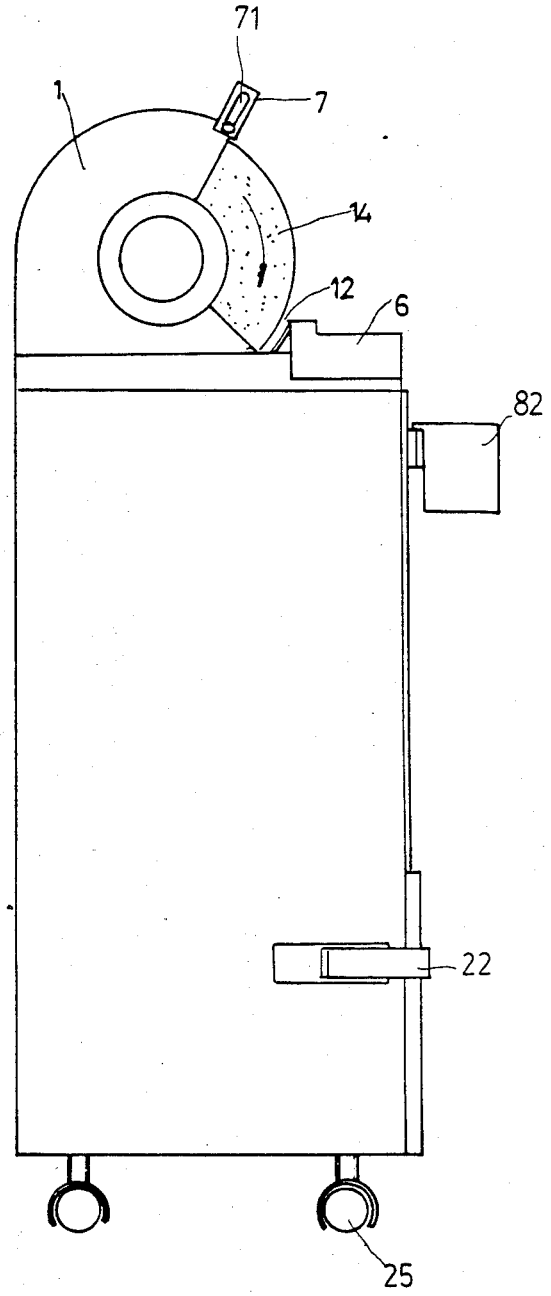
FIG. 4 is a side view of the dust collector for grinder.
Figure 5:
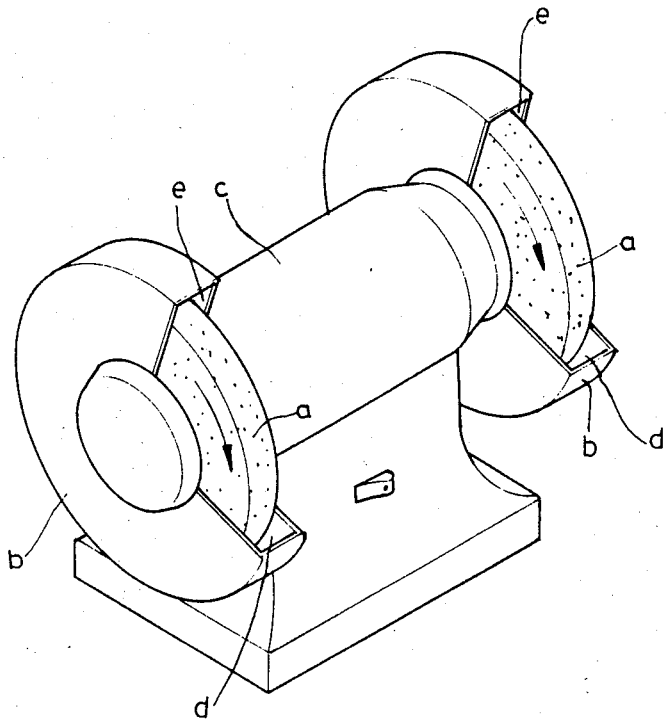
FIG.5 PRIOR ART
FIG. 5 is a perspective view of a known grinder.
Figure 6:
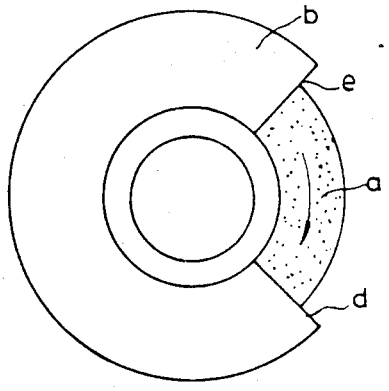
FIG.6 PRIOR ART
FIG. 6 is a side view of the known grinder.
Figure 7:
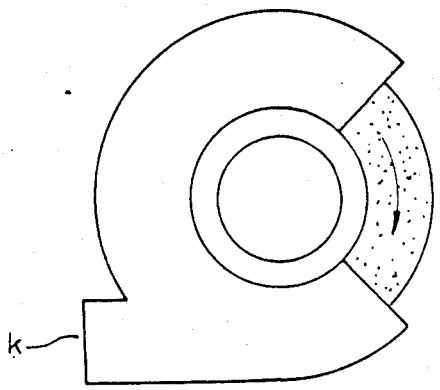
FIG7 PRIOR ART
FIG. 7 is a side view showing a modification of the dust hood of the known grinder shown in FIG. 5.

Turning to FIG. 4, a slit is formed between the blocking frame (6) and the inlet (12). The shield (7) is placed as close as possible to the grinding wheel (14), but not in contact with the grinding wheel (14). When grinding, the air accompanied with the dust produced will be sucked into the hood (1). It is noted that the air sucked into the hood (1) can scarely exhaust from the slit formed between the shield (7) and the grinding wheel (14). The air flow speed near the slit is 0.3 m/sec, which is almost equal to the air flow speed in a room. The air accompanied with the dust passes through the passage (21) to the dust chamber (5). Meanwhile, the dust with larger diameter and density will fall onto the bottom of the dust chamber (5), while the air accompanied with the dust of smaller diameter and density will pass through the filter box (4), thereby collecting and filtering the dust out of the air and therefore, keeping the air fresh.

Turning to FIG. 2 again, the blocking frames (6) and the shields (7) are adjustably mounted on the lower part and the upper part of the hoods (1) respectively, so that they can be suitably regulated when the grinding wheels (4) are worn out.

Although this invention has been described with a certain degree of particularity, it is understood that the present disclosure has been made by way of example only, and that numerous changes in the detail of construction and the combination and arrangement of parts may be resorted to without departing from the spirit and scope of the invention as hereinafter claimed.

I claim:

1. A dust collector for a grinder, comprising:

a dust bin having wall means for defining two vertical passages located respectively at opposite sides of and within the dust bin, a first space located between said two vertical passages, a second space formed below said first space and in communication with said first space and said vertical passages, and a plurality of holes formed in a top wall of the dust bin and in communication with said first space;

a filter box adapted to be received in the first space of said dust bin;

a dust chamber adapted to be received in the second space of said dust bin;

two hoods respectively mounted on the two vertical passages of said dust bin, each said hood being composed of two parts;

two blocking frames each adjustably mounted on a lower part of one of said hoods; and two shields each adjustably mounted on an upper part of one of said hoods.

2. The dust collector of claim 1, further including a pair of grinding wheels respectively mounted within said hoods, rotation of said grinding wheels creating air currents directing dust particles into the collector so that large dust particles tend to fall through the vertical passages directly into the dust chamber with light particles being directed into said filter box for filtering out of the air.

* * * * *